US009576542B1

(12) United States Patent
Pollack et al.

(10) Patent No.: US 9,576,542 B1
(45) Date of Patent: Feb. 21, 2017

(54) USING DISPLAY COMPONENTS FOR LIGHT SENSING

(71) Applicant: Amazon Technologies, Inc., Seattle, WA (US)

(72) Inventors: Joel Martin Pollack, San Jose, CA (US); Jerry Yee-Ming Chung, Los Altos, CA (US)

(73) Assignee: Amazon Technologies, Inc., Seattle, WA (US)

( * ) Notice: Subject to any disclaimer, the term of this patent is extended or adjusted under 35 U.S.C. 154(b) by 65 days.

(21) Appl. No.: 14/558,597

(22) Filed: Dec. 2, 2014

(51) Int. Cl.
*G09G 3/36* (2006.01)

(52) U.S. Cl.
CPC ..... *G09G 3/3614* (2013.01); *G09G 3/3648* (2013.01); *G09G 3/3696* (2013.01)

(58) Field of Classification Search
CPC ..... H01L 31/1055; H01L 27/1446; G09G 3/3225
See application file for complete search history.

(56) References Cited

U.S. PATENT DOCUMENTS

| | | | | |
|---|---|---|---|---|
| 5,485,177 | A * | 1/1996 | Shannon | G06F 3/0412 345/182 |
| 9,280,930 | B2 * | 3/2016 | Somerville | G09G 3/3216 |
| 2005/0082968 | A1 * | 4/2005 | Choi | G09G 3/3225 313/506 |
| 2006/0077186 | A1 * | 4/2006 | Park | G06F 3/0412 345/173 |
| 2009/0237381 | A1 * | 9/2009 | Otani | G02F 1/1362 345/207 |

* cited by examiner

*Primary Examiner* — Shaheda Abdin
(74) *Attorney, Agent, or Firm* — Sutherland Asbill & Brennan LLP

(57) ABSTRACT

This disclosure relates to, among other things, devices, systems, methods, computer-readable media, techniques, and methodologies that utilize and/or incorporate display components capable of being configured to detect light.

19 Claims, 6 Drawing Sheets

USING DISPLAY COMPONENTS FOR LIGHT SENSING

BACKGROUND

A mobile device such as a smartphone, tablet, or electronic reader may include an ambient light sensor for detecting ambient light incident on a display of the device. The ambient light sensor may be provided at a periphery of the device, for example. An amount of light transmitted through, emitted by, or reflected by the display may be adjusted based on output from the sensor by controlling a backlight or frontlight unit of the display and/or driving circuitry for driving pixels of the display. For example, in bright ambient light conditions, the brightness of the display may be reduced to compensate for ambient brightness.

There has been an increasing trend towards reducing border areas of mobile devices in order to maximize the display area. A consequence of this trend has been a reduced amount of device real estate available for providing an ambient light sensor, an image sensor, or the like.

BRIEF DESCRIPTION OF THE DRAWINGS

The detailed description is group forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. In the drawings, the left-most digit(s) of a reference numeral identifies the drawing in which the reference numeral first appears. The use of the same reference numerals indicates similar, but not necessarily the same or identical components. However, different reference numerals may be used to identify similar components as well. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Figure 1:
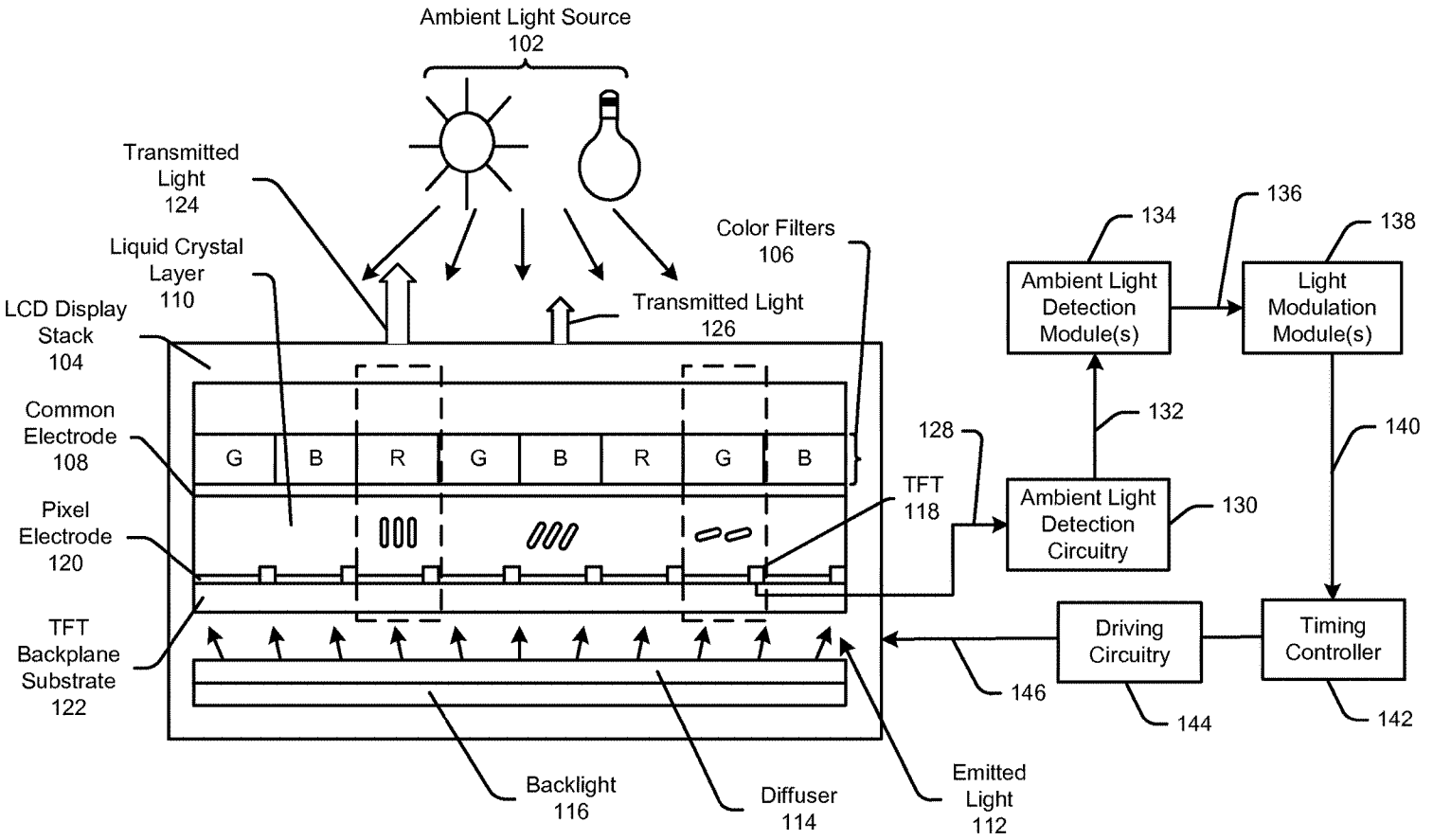
FIG. 1 is a schematic diagram of an illustrative display and ambient light detection architecture in accordance with one or more example embodiments of the disclosure.

This disclosure relates to, among other things, devices, systems, methods, computer-readable media, techniques, and methodologies that utilize and/or incorporate display components capable of being configured to detect light. In an example embodiment, transistors forming part of pixels of a display may be used as phototransistors to detect ambient light. The amount of light emitted by a display, emitted by an internal backlight and transmitted by the display, or emitted by an internal frontlight and reflected by the display may then be adjusted based on the amount of ambient light detected. In an example embodiment, a time-division multiplexing approach may be used in which a transistor is caused to drive a corresponding pixel for a first portion of an addressing interval and is reverse-biased during a second portion of the addressing interval in order to cause the transistor to function as a phototransistor. An addressing interval may correspond to a period of time during which a storage capacitor of a pixel substantially maintains a charge corresponding to a voltage applied to a transistor of the pixel, thereby causing the pixel to emit, transmit, or reflect an amount of light corresponding to the applied voltage. The second portion of the addressing interval may occur before or after the first portion of the addressing interval and may be substantially shorter in duration than the first portion.

In another example embodiment, a dedicated group of transistors may be used solely as phototransistors to detect ambient light rather than to drive pixels. The dedicated group of transistors may be provided along a periphery of the display or at one or more other positions of the display so as not to generate visible artifacts. Thus, the dedicated group of phototransistors may be located closer to a periphery of the display than display pixels. The dedicated number of transistors used for light sensing may be substantially smaller than the number of transistors used for driving pixels. In yet another example embodiment, a group of photodiodes may be incorporated into a display at various pixel positions and may be used for light sensing in lieu of transistors that would typically be provided at such positions.

In addition, in certain example embodiments, a color temperature of ambient light may be determined based on a comparison of signals received from phototransistors or photodiodes associated with different color sub-pixels. The color temperature may then be used to, for example, adjust the white point of a display. While example embodiments may be described herein in connection with ambient light sensing applications, it should be appreciated that such embodiments are also applicable to image sensing applications as well. For example, one or more transistors may be used as image sensors.

Display technologies may be broadly categorized as either emissive or non-emissive. Emissive displays are displays that generate and emit light. Non-emissive displays, on the other hand, utilize optical effects to convert ambient light or light emitted from an internal light source into graphical patterns. Examples of emissive displays include, for example, a gas discharge display, an electrochemical display (ECD), an electroluminescent display (ELD), a vacuum fluorescent display (VFD), a surface-conduction electronic-emitter display (SED), a field emission display (FED, a cathode ray tube (CRT), light-emitting diode (LED) displays, organic light-emitting diode (OLED) displays, inorganic light-emitting diode (ILED) displays, and so forth. In those example embodiments in which the emissive display is an OLED or ILED display, the display may be a top-emitting or bottom-emitting OLED or ILED display. Non-emissive displays may include reflective, transmissive, or transflective displays. Examples of non-emissive displays include, for example, frontlit or backlit liquid crystal displays (LCDs), electrophoretic displays, electrowetting displays, and so forth. LCD displays may include twisted nematic LCDs, in-plane switching LCDs, or the like, and may be directly or actively addressed.

Referring now to FIG. 1, in an example embodiment of the disclosure, a backlit LCD display may be provided. Although a backlit LCD display is shown for explanatory purposes, it should be appreciated that the display may be a frontlit LCD display instead. The LCD display may include a display stack 104 that may include a thin-film-transistor (TFT) backplane array. The TFT backplane array may include a substrate 122 which may be, for example, a transparent glass substrate. An array of pixels may be formed on the substrate 122. Each pixel may include a pixel electrode 120 and one or more TFTs 118. Each TFT 118 forming part of the TFT backplane array may control a particular pixel of the display, thereby allowing each pixel to be individually addressed.

A TFT 118 may be a type of field-effect transistor (FET) having a source terminal, a gate terminal, and a drain terminal. An FET includes an active channel that forms in a semiconductor layer and through which charge carriers—electrons or holes—flow from the source to the drain when a gate-source voltage in excess of a threshold voltage is applied. A TFT 118 may be formed by depositing thin films of an active semiconductor layer as well as a dielectric layer and metallic contacts over a supporting and non-conducting substrate such as glass. A TFT 118 may have any of a wide variety of structures that may be defined by the order of deposition of the semiconductor layer, the source and drain contacts, and the gate electrode. For example, a TFT 118 may have a top-gate structure in which the source and drain electrodes are first deposited on the substrate, followed by the semiconductor layer, the dielectric layer, and the gate electrode. As another example, a TFT 118 may instead have a bottom-gate structure in which the gate electrode is first deposited on the substrate. The source, drain, and gate electrodes may be formed of any suitable material including, but not limited to, gold, indium-tin-oxide (ITO), or the like. The semiconductor layer may be formed of amorphous silicon (a-Si), low temperature poly-silicon (LTPS), a metal oxide such as indium gallium zinc oxide (IGZO), or the like. A TFT 118 having a top-gate or a bottom-gate structure may have a staggered configuration or a coplanar configuration. In the staggered configuration, the source and drain electrodes are provided on an opposing side of the semiconductor layer as the gate electrode. In the coplanar configuration, the source and drain electrodes are provided on a same side of the semiconductor layer as the gate electrode.

In those example embodiments in which the LCD display is a backlit LCD display, the LCD display stack 104 may further include a backlight 116. The backlight 116 may be any suitable light source such as, for example, a cold cathode fluorescence lamp (CCFL), a white light emitting diode (LED), an RGB LED, or the like. The backlight 116 may illuminate the LCD from the back or side of the display panel. While FIG. 1 illustratively depicts a backlight 116, it should be appreciated that other light sources may be employed such as, for example, a frontlight or the like. A diffuser 114 may be provided to cause the light emitted by the backlight 116 to be evenly distributed across the display panel. In certain example embodiments, other component(s) such as a lightguide may be provided to assist with even distribution of the light to the display panel.

Light 112 emitted from the backlight 116 and diffused through the diffuser 114 may pass through the TFT backplane substrate 122 and reach each pixel of the display stack 104. In an actively-addressed LCD display panel, a series of intersecting column data lines and row scanning lines (not shown) may be provided. Each scanning line may be connected to each gate electrode of each TFT 118 in a same row of the TFT backplane array. Each data line may be connected to each source electrode of each TFT 118 in a same column of the TFT backplane array. Each TFT 118 may be controlled by two pulse signals generated by driving circuitry 144 in response to command signals received from a timing controller 142. The driving circuitry 144 may include a row driver and a column driver (not shown in FIG. 1) for providing the pulse signals to scanning lines and data lines. In particular, gate pulses may be provided to each horizontal scanning line during successive addressing intervals. When a gate pulse corresponding to a gate-source voltage that exceeds the threshold voltage of a TFT 118 is applied to a scanning line, the TFT 118 may be switched to an 'ON' state allowing current to flow from the source to the drain. The column driver may then concurrently provide a pulse signal (e.g., a voltage) to a corresponding data line, which may cause a storage capacitor forming part of a corresponding pixel to be charged. The TFT 118 may then transition to an 'OFF' state upon receipt of the negative edge of the gate pulse, and the storage capacitor may maintain the resultant charge until the next addressing interval. The storage capacitor charge may cause corresponding liquid crystal molecules in a liquid crystal layer 110 to re-orient themselves in accordance with the magnitude of the voltage applied to the data line.

Although not shown in FIG. 1, the display stack 104 may include a first polarizer that passes that portion of the emitted light 112 having a first polarization and a second polarizer that passes that portion of the emitted light 112 having a second polarization that is orthogonal to the first polarization. The liquid crystal molecules may naturally orient themselves such that when no voltage is applied to a data line, light passed by the first polarizer (e.g., light having the first polarization) is altered to the second polarization, thereby allowing the light to pass through the second polarizer. Thus, when no voltage is applied to a data line, the pixels connected to that data line may be in their most transmissive state. A voltage can be applied to a data line to alter the orientation of liquid crystal molecules and attain intermediate levels of light transmission. A voltage applied to a data line that exceeds a certain threshold value may result in parallel alignment of liquid crystal molecules, and thus, no rotation of light from the first polarization to the second polarization and no transmission of light through corresponding pixels.

Referring again to the LCD display stack 104, each pixel may include one or more individually addressable sub-pixels, with each sub-pixel being associated with a corresponding color filter 106. For example, each sub-pixel may have a red, green, or blue color filter 106 associated therewith that filters light passing through the liquid crystal layer 110 and a common electrode 108, which may be a transparent electrode. In certain example embodiments, a combination of red, green, and blue sub-pixels may form a pixel of the display. It should be appreciated that any discussion referencing a pixel herein may also be applicable to a sub-pixel. Further, while example embodiments may be described in connection with RGB displays, it should be appreciated that embodiments directed to RGBW displays are also within the scope of the disclosure.

As shown in FIG. 1, one or more computer processors may send a signal to the timing controller 142 which, in turn, may cause the driving circuitry 144 to apply a voltage (e.g., a row pulse) to the scanning line connected to gate electrodes of TFTs 118 associated with a same row of sub-pixels. The voltage may be a gate-source voltage that exceeds a threshold voltage of the TFTs 118, causing the TFTs 118 to successively switch to an 'ON' state. While each TFT 118 is in the 'ON' state, the driving circuitry 144 may apply a voltage to a corresponding data line causing a corresponding sub-pixel to transmit light through the liquid crystal layer 110 at an amount determined by the applied voltage. For example, a first voltage may be applied to a data line corresponding to a sub-pixel associated with a red color filter 106, causing a first amount of light 124 to be transmitted through that sub-pixel. A second higher voltage may be applied to a data line corresponding to a sub-pixel associated with a blue color filter 106, causing a second lesser amount of light 126 to be transmitted through that sub-pixel. Similarly, various other voltages may be applied to other data lines to cause light to be transmitted through other corresponding sub-pixels at various amounts.

In certain example embodiments, one or more TFTs 118 may be configured so as to be capable of being reverse-biased. For example, a respective bias line may be connected to the gate electrode of each such TFT 118. In response to a signal received from one or more computer processors, the timing controller 142 to cause the driving circuitry 144 to apply a voltage to the bias line to cause the TFT 118 to become reverse-biased. Reverse-biasing a TFT 118 in this manner may allow the TFT 118 to function as a phototransistor. In particular, when a photon of ambient light from an ambient light source 102 contacts the semiconductor layer of a reversed-biased TFT 118, an electron-hole pair may be generated within a depletion region of the semiconductor layer. The holes may be caused to move towards the anode and the electrons towards the cathode by an electric field of the depletion region, thereby generating a photocurrent 128.

The photocurrent 128 may be detected by ambient light detection circuitry 130. The ambient light detection circuitry 130 may include an amplifier for amplifying the photocurrent 128 and an analog-to-digital converter (ADC) for converting the amplified current to a digital signal 132. The digital signal 132 may be provided to one or more ambient light detection module(s) 134 that may include computer-executable instructions that responsive to execution by one or more computer processors may cause an intensity of ambient light to be determined from the digital signal 132. In certain example embodiments, digital signals corresponding to photocurrents generated by multiple reversed-biased TFTs 118 may be provided as input to the ambient light detection module(s) 134 to determine an average (or other statistical measure) of the intensity of ambient light.

The ambient light detection module(s) 134 may provide one or more values 136 indicative of the intensity of the ambient light to one or more light modulation modules 138 which may, in turn, supply the timing controller 142 with one or more signals 140 indicative of data line voltages 146 to be applied to cause an amount of light transmitted through one or more sub-pixels of the display to be modulated to compensate for the detected intensity of the ambient light. The timing controller 142 may control the driving circuitry 144 to apply the data line voltages 146. In this manner, light transmitted through the display may be adjusted to account for variance in the intensity of detected ambient light. For example, in bright ambient light conditions, the brightness of the display may be increased. Similarly, in low ambient light conditions, the brightness of the display may be reduced to converse battery power. In certain example embodiments, a difference between the intensity of the detected ambient light and a reference intensity of ambient light may be determined, and this difference may be used to determine an appropriate value of the data line voltage 146 to be applied to compensate for either the increased or decreased intensity of the ambient light as compared to the reference intensity of the ambient light. More specifically, the difference may be used to determine an amount of which an existing data line voltage should be modified to compensate for the detected intensity of the ambient light conditions.

In certain example embodiments, the timing controller 142 may utilize a time-division multiplexing approach according to which, during a first portion of an addressing interval, the timing controller 142 causes the driving circuitry 144 to provide a voltage to a scanning line to successively switch TFTs 118 associated with a row of sub-pixels to an 'ON' state, thereby allowing the TFTs 118 to drive the sub-pixels in accordance with voltages applied to corresponding data lines. Then, during a second portion of the addressing interval, the timing controller 142 may cause the driving circuitry 144 may supply voltages to bias lines connected to the TFTs 118 to reverse-bias the TFTs 118. While reverse-biased, the TFTs 118 may function as phototransistors for ambient light detection. This time-division multiplexing approach may be applied for each sub-pixel that is addressed. In certain example embodiments, the second portion of an addressing interval during which a TFT 118 is reverse-biased may be substantially shorter than the first portion of time during which the corresponding sub-pixel transmits light. In certain other example embodiments, while a first group of sub-pixels are being addressed, a second group of sub-pixels may be reversed-biased to function as phototransistors. In still other example embodiments, rather than reverse-bias each TFT 118 for some portion of an addressing interval such that each TFT 118 functions as a phototransistor for some period of time, only a smaller subgroup of TFTs 118 may be reverse-biased for a portion of the addressing interval. Thus, in certain example embodiments, certain TFTs 118 may never be reverse-biased during any portion of an addressing interval.

In other example embodiments, rather than partitioning the addressing interval of a sub-pixel into a first period of time during which the corresponding TFT 118 is switched to an 'ON' state and the sub-pixel is driven and a second period of time during which the TFT 118 is reverse-biased to function as a phototransistor, a dedicated group of TFTs 118 may instead be used solely as phototransistors to detect ambient light rather than for driving pixels. The dedicated group of TFTs 118 may be provided along a periphery of the display or at one or more other positions of the display so as not to generate visible artifacts. The dedicated number of TFTs 118 used solely for light sensing may be substantially smaller than the number of TFTs 118 used for driving pixels so that the display characteristics are not noticeably affected.

In yet other example embodiments, a group of photodiodes may be incorporated into a display at various pixel positions and used for light sensing in lieu of TFTs 118s that would typically be provided at such positions.

In addition, in certain example embodiments, a color temperature of ambient light may be determined based on a comparison of signals received from phototransistors or photodiodes associated with different color sub-pixels. For example, the ambient light detection module(s) 134 may compare photocurrents 128 generated by reversed-biased TFTs 118 associated with red sub-pixels to photocurrents 128 generated by reverse-biased TFTs 118 associated with blue and/or green sub-pixels to determine a color temperature of the incoming ambient light. The color temperature may then be used by the light modulation module(s) 138 to, for example, adjust the white point of a display. For example, if the color temperature indicates that the ambient light is shifted towards a particular portion of the visible light spectrum, the light modulation module(s) 138 may provide signals to the timing controller 142 which may cause the driving circuitry 144 to supply voltages that cause light transmitted through the display to compensate for the shift in the ambient light.

While example embodiments of the disclosure may be described herein in connection with backlit LCDs, it should be appreciated that such embodiments are also applicable to other types of emissive and non-emissive displays. For example, one or more pixels of an OLED or ILED display may not have an emissive layer deposited thereon. In this manner, ambient light may be able to reach TFTs corresponding to such pixels, thereby allowing such TFTs to function as phototransistors.

Example embodiments of the disclosure provide a number of technical features or technical effects. For example, in accordance with example embodiments of the disclosure, an existing TFT backplane of a display may be used to provide light sensing functions without requiring significant modification to the TFT backplane circuitry by using a time-division multiplexing approach as described earlier and/or using a dedicated group of TFTs solely as phototransistors. Such an approach obviates the need for a separate ambient light sensor and/or image sensor. Further, such an approach that utilizes display components for light sensing avoids the possibility of a user inadvertently obscuring an ambient light sensor provided at a periphery of a device adjacent to a display, as may occur with conventional devices. In addition, utilizing the time-division multiplexing approach described herein and/or a suitable number of dedicated phototransistors allows for a sufficient amount of ambient light to reach the phototransistors for detection despite the attenuation of light that occurs through the liquid crystal layer. It should be appreciated that the above examples of technical features and/or effects of example embodiments of the disclosure are merely illustrative and not exhaustive.

One or more illustrative embodiments of the disclosure have been described above. The above-described embodiments are merely illustrative of the scope of this disclosure and are not intended to be limiting in any way. Accordingly, variations, modifications, and equivalents of embodiments disclosed herein are also within the scope of this disclosure. The above-described embodiments and additional and/or alternative embodiments of the disclosure will be described in detail hereinafter through reference to the accompanying drawings.

Figure 2A:
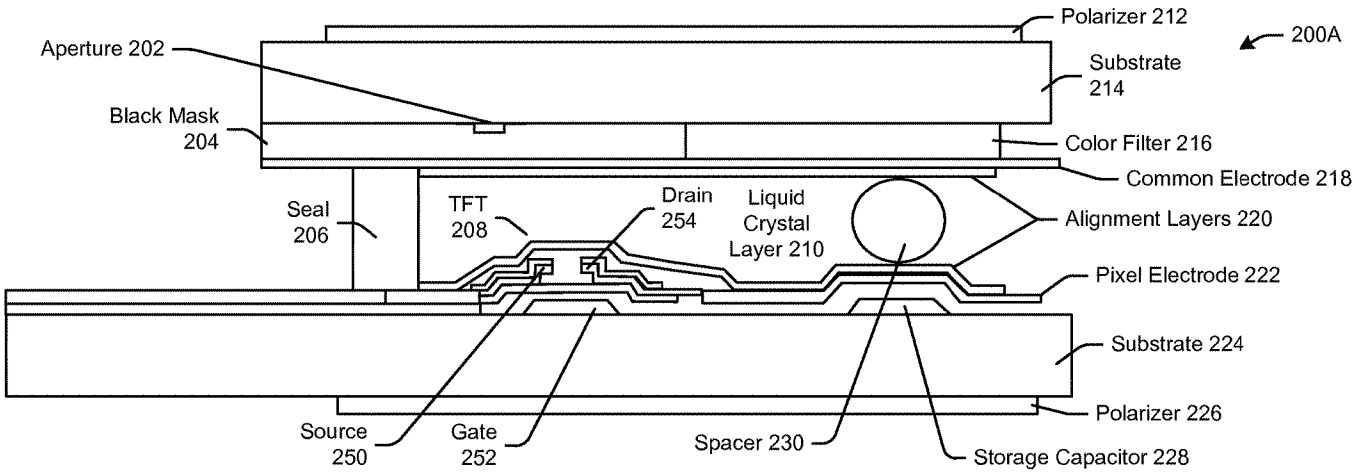
FIG. 2A is a schematic diagram of a cross-section of an illustrative display pixel configured for use as a light sensor in accordance with one or more example embodiments of the disclosure.
Figure 2B:
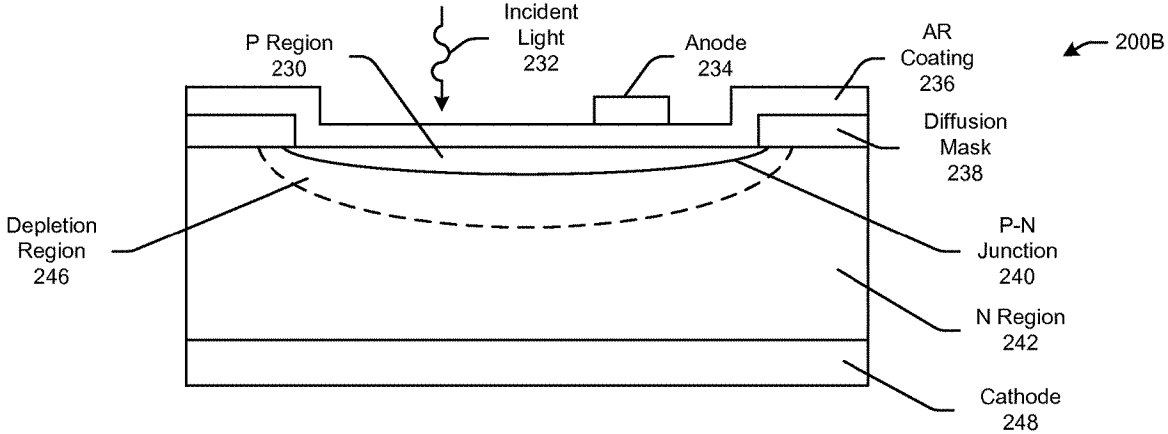
FIG. 2B is a schematic diagram of a cross-section of an illustrative photodiode for incorporation into a display panel in accordance with one or more example embodiments of the disclosure.

FIG. 2A is a schematic diagram of a cross-section of an illustrative display pixel configured for use as a light sensor in accordance with one or more example embodiments of the disclosure. FIG. 2B is a schematic diagram of a cross-section of an illustrative photodiode for incorporation into a display panel in accordance with one or more example embodiments of the disclosure.

Referring first to FIG. 2A, a cross-section of an example display pixel 200A (or sub-pixel) in accordance with one or more example embodiments of the disclosure is shown. The display pixel 200A may include a first polarizer 226 that passes light having a first polarization among light emitted from, for example, a backlight (not shown). The light having a first polarization may be polarized in a first plane. The display pixel 200A may further include a second polarizer 212 that passes portions of light having a second polarization that is orthogonal to the first polarization. That is, light having the second polarization may be polarized in a second plane that is orthogonal to the first plane. Thus, light entering the display pixel 200A may have the first polarization which may be orthogonal to the second polarization of light exiting the display pixel 200A. One or both of the polarizer 226 and the polarizer 212 may be common to the display pixel 200A and one or more additional pixels.

The display pixel 200A may further include a substrate 224 and a substrate 214, which may be formed of a transparent material such as glass. The display pixel 200A may also include a pixel electrode 222 and a common electrode 218. The pixel electrode 222 may correspond to the particular display pixel 200A while the common electrode 218 may be common to the display pixel 200A and one or more additional pixels. At least the common electrode 218 may be a transparent electrode. A spacer 230 may be provided for maintaining a space between the common electrode 218 and the pixel electrode 222, and a liquid crystal material 210 may be provided in the space between the electrodes. A seal 206 may be provided for containing the liquid crystal within the display pixel 200A. Alignment layers 220 may be provided for aligning liquid crystal molecules near the surfaces of the electrodes to correspond to the orientations of plane polarized light passed by the polarizer 226 and the polarizer 212. In addition, a color filter 216 may be provided that causes light of a particular portion of the visible spectrum to be transmitted through the display pixel 200A.

The display pixel 200A may further include a TFT 208, which may have any suitable structure described above. For example, the TFT 208 may include a source electrode 250, a gate electrode 252, and a drain electrode 254. As previously described, a gate-source voltage applied to a scanning line connected to the gate electrode 2542 of the TFT 208 may switch the TFT 208 to an 'ON' state, and a voltage applied to a data line may charge a storage capacitor 228 of the display pixel 200A. The charge of the storage capacitor 228 may cause liquid crystal molecules to change orientation, thereby modulating the amount of light transmitted through the display pixel 200A. Further, as previously described, a bias line may be connected to the TFT 208 via which a bias voltage may be provided to reverse-bias the TFT 208 to cause the TFT 208 to function as a phototransistor.

The display pixel 200A may include a black mask 204 that may be provided to prevent ambient light from activating the TFT 208 and switching it to an 'ON' state. In accordance with example embodiments of the disclosure, an aperture 202 may be formed in the black mask 204 to allow enough ambient light to reach the TFT 208 to permit generation of a photocurrent when the TFT 208 is reverse-biased, while still preventing the ambient light from activating the TFT 208.

Referring now to FIG. 2B, a cross-section of an example photodiode 200B is shown. The photodiode 200B may be incorporated into a display panel such as a TFT LCD panel in accordance with one or more example embodiments of the disclosure. More specifically, the photodiode 200B may replace one or more transistors of a TFT backplane array such as the TFT backplane array depicted in FIG. 1 as part of the LCD display stack 104. That is, one or more pixels may each include a respective photodiode 200B for light detection in lieu, or in addition to, a TFT. In those example embodiments in which a pixel includes both a TFT and a photodiode 200B, the TFT may be used solely for driving the pixel for light transmission and the photodiode 200B may be used solely for light detection.

The photodiode 200B may include an n-type bulk silicon region 242. A thin p-type layer 230 may be formed in the n-type region 242 by thermal diffusion or ion implantation of an appropriate dopant. A p-n junction 240 may be formed at an interface between the p-type layer 230 and the bulk n-type region 242. A metal contact (e.g., anode 234) may be applied to a front surface of the photodiode 200B and another metal contact (e.g., cathode 248) may be applied to a back surface of the photodiode 200B. A coating 236 and/or a diffusion mask 238 formed of, for example, silicon nitride, silicon monoxide or silicon dioxide may be applied to an active area of the photodiode 200B for protection and/or to provide anti-reflection properties. Charge carriers may become depleted near the p-n junction 240, forming a depletion region 246. The depth of the depletion region 246 may be increased by applying a reverse bias voltage across the p-n junction 240. When light 232 is absorbed in the depletion region 246, an electron-hole pair is formed. The electrons and holes are separated with electrons passing to the n-type region 242 and holes to the p-type region 230. As a result, a photocurrent may be generated that may be detected by the ambient light detection circuitry 130 as previously described. It should be appreciated that while an example photodiode 200B that uses a p-n junction is depicted, other suitable photodiodes may be used as well such as, for example, a PIN photodiode.

Illustrative Device Architecture

Figure 6:
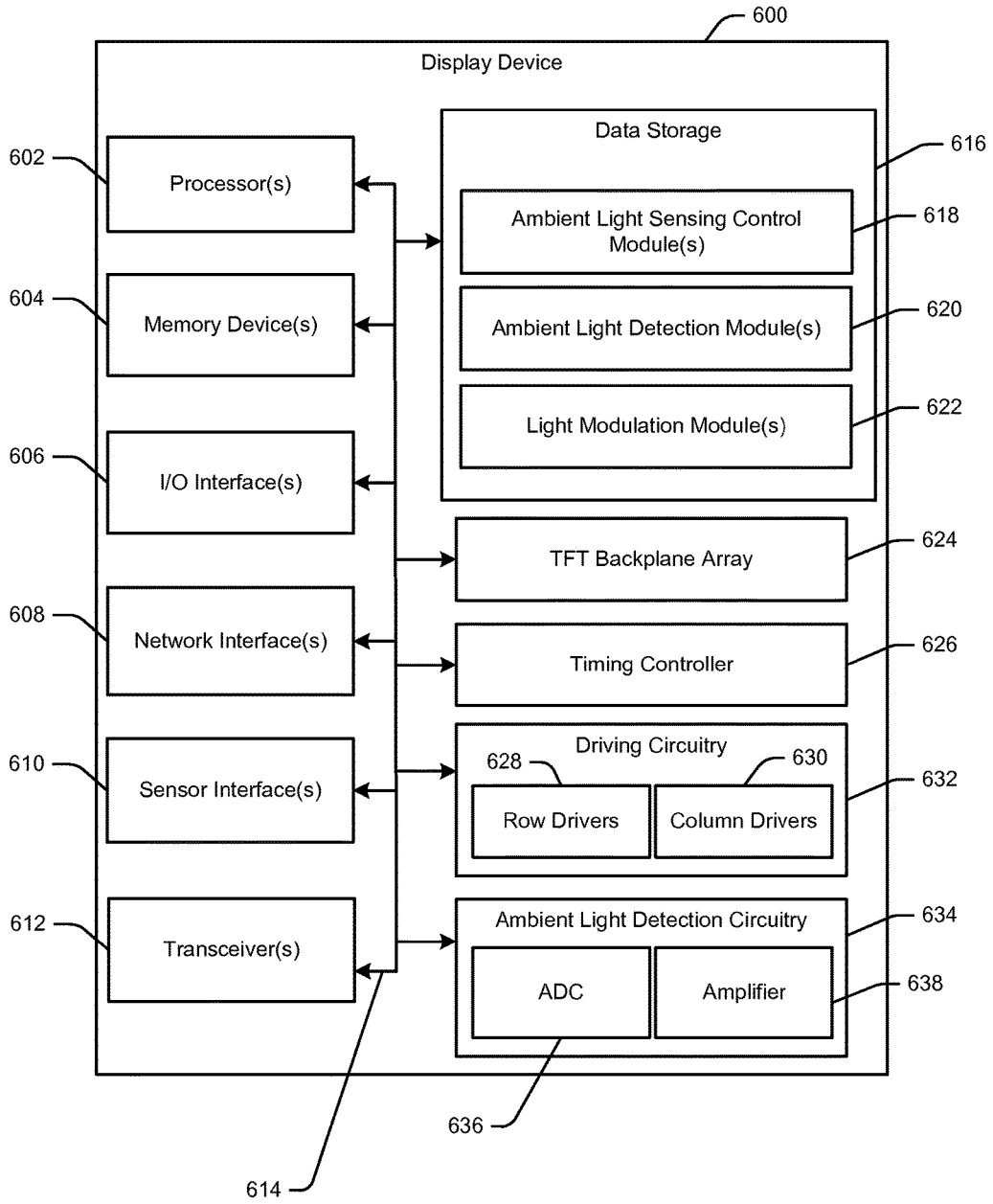
FIG. 6 is a schematic diagram of an illustrative display device in accordance with one or more example embodiments of the disclosure.

FIG. 6 is a schematic diagram of an illustrative display device 600 that may include display components configured for light detection in accordance with one or more example embodiments of the disclosure. The device 600 may be, for example, a mobile device such as a smartphone, tablet device, electronic reader device, wearable computing device, or the like. Alternatively, the device 600 may be a monitor, a television, or other type of similar display device, in which case, one or more components depicted in FIG. 6 may not be present.

In an illustrative configuration, the device 600 may include one or more processors (processor(s)) 602, one or more memory devices 604 (generically referred to herein as memory 604), one or more input/output ("I/O") interface(s) 606, one or more network interfaces 608, one or more sensors or sensor interfaces 610, one or more transceivers 612, data storage 616, a TFT backplane array 624, a timing controller 626, driving circuitry 632, and ambient light detection circuitry 634. In certain example embodiments, the driving circuitry 632 may correspond to the driving circuitry 144 and the ambient light detection circuitry 634 may correspond to the ambient light detection circuitry 130. The device 600 may further include one or more buses 614 that functionally couple various components of the device 600. The device 600 may further include one or more antennas (not shown) that may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 614 may include at least one of a system bus, a memory bus, an address bus, or a message bus, and may permit exchange of information (e.g., data (including computer-executable code), signaling, etc.) between various components of the device 600. The bus(es) 614 may include, without limitation, a memory bus or a memory controller, a peripheral bus, an accelerated graphics port, and so forth. The bus(es) 614 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnects (PCI) architecture, a PCI-Express architecture, a Personal Computer Memory Card International Association (PCMCIA) architecture, a Universal Serial Bus (USB) architecture, and so forth.

The memory 604 of the device 600 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 604 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 604 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 616 may include removable storage and/or non-removable storage including, but not limited to, magnetic storage, optical disk storage, and/or tape storage. The data storage 616 may provide non-volatile storage of computer-executable instructions and other data. The memory 604 and the data storage 616, removable and/or non-removable, are examples of computer-readable storage media (CRSM) as that term is used herein.

The data storage 616 may store computer-executable code, instructions, or the like that may be loadable into the memory 604 and executable by the processor(s) 602 to cause the processor(s) 602 to perform or initiate various operations. The data storage 616 may additionally store data that may be copied to memory 604 for use by the processor(s) 602 during the execution of the computer-executable instructions. Moreover, output data generated as a result of execution of the computer-executable instructions by the processor(s) 602 may be stored initially in memory 604, and may ultimately be copied to data storage 616 for non-volatile storage.

More specifically, the data storage 616 may store one or more program modules such as, for example, one or more ambient light sensing control modules 618, one or more ambient light detection modules 620 and one or more light modulation modules 622. In certain example embodiments, the ambient light detection module(s) 620 may correspond to the ambient light detection module(s) 134 and the light modulation module(s) 138 may correspond to the light modulation module(s) 138. The data storage 616 may further store any of variety of other types of modules. Further, any program modules stored in the data storage 616 may include one or more sub-modules. Although not depicted in FIG. 6, the data storage 616 may store other computer-executable code such as, for example, one or more operating systems that may be loaded from the data storage 616 into the memory 604 and which may provide an interface between other program modules executing on the device 600 and hardware resources of the device 600. In addition, the data storage 616 may store various types of data that may be provided as input to a program module or generated as a result of execution of computer-executable instructions of a program module. Any data stored in the data storage 616 may be loaded into the memory 604 for use by the processor(s) 602 in executing computer-executable code. It should be appreciated that "data," as that term is used herein, includes computer-executable instructions, code, or the like.

Referring now to functionality supported by the various program modules depicted in FIG. 6, the light modulation module(s) 622 may include computer-executable instructions, code, or the like that responsive to execution by one or more of the processor(s) 602 may cause processing to be performed to generate and transmit signals to the timing controller 626 to cause the driving circuitry 632 to supply gate and data voltages to a transistor during a first portion of an addressing interval in order to modulate an amount of light transmitted through a corresponding pixel.

The ambient light sensing control module(s) 618 may include computer-executable instructions, code, or the like that responsive to execution by one or more of the processor(s) 602 may cause processing to be performed to generate and transmit signals to the timing controller 626 to cause the driving circuitry 632 to supply a reverse-bias voltage to the transistor during a second portion of the addressing interval in order to cause the transistor to function as a phototransistor for light detection. In other example embodiments, the ambient light sensing control module(s) 618 may generate and transmit signals to the timing controller 626 to cause the driving circuitry 632 to supply a reverse-bias voltage to a dedicated transistor to cause the transistor to function as a phototransistor for light detection. In such example embodiments, the dedicated transistor may not be used to drive a corresponding pixel.

The ambient light detection module(s) 620 may include computer-executable instructions, code, or the like that responsive to execution by one or more of the processor(s) 602 may cause processing to be performed to receive digital data indicative of photocurrents generated by exposure to ambient light and determine an intensity of the ambient light. The light modulation module(s) 622 may further include computer-executable instructions, code, or the like that responsive to execution by one or more of the processor(s) 602 may cause processing to be performed to generate and transmit signals to the timing controller 626 to cause the driving circuitry 632 to supply gate and data voltages to modulate the amount of light transmitted through one or more pixels based on the intensity of the ambient light detected.

Referring now to other illustrative components of the device 600, the TFT backplane array 624 may include any number of TFTs, one or more of which may be configured to detect ambient light. For example, the TFT backplane array 624 may include one or more transistors 200A. In addition, although not depicted in FIG. 6, the device 600 may include any other example components of the LCD display stack 104 and/or the photodiode 200B.

The driving circuitry 632 may include a row driver 628 and a column driver 630 for supplying gate voltages on row lines and data voltages on column lines, respectively, in response to timing and data signals received from the timing controller 626. Further, in certain example embodiments, the timing controller 626 and the driving circuitry 632 may form part of a same integrated circuit (IC) chip, while in other example embodiments, the timing controller 626 and the driving circuitry 632 may be provided on two or more separate IC chips.

The ambient light detection circuitry 634 may include an amplifier 638 for amplifying a photocurrent generated by a photodiode or a transistor reverse-biased to function as a phototransistor in accordance with one or more example embodiments of the disclosure. The ambient light detection circuitry 634 may further include an analog-to-digital converter (ADC) 636 for converting the analog signal from the amplifier 638 into a digital signal capable of being processed by the ambient light detection module(s) 620.

Referring now to other illustrative components of the device 600, the processor(s) 602 may be configured to access the memory 604 and execute computer-executable instructions loaded therein. For example, the processor(s) 602 may be configured to execute computer-executable instructions of the various program modules of the user device 600 to cause or facilitate various operations to be performed in accordance with one or more embodiments of the disclosure. The processor(s) 602 may include any suitable processing unit capable of accepting data as input, processing the input data in accordance with stored computer-executable instructions, and generating output data. The processor(s) 602 may include any type of suitable processing unit including, but not limited to, a central processing unit, a microprocessor, a Reduced Instruction Group Computer (RISC) microprocessor, a Complex Instruction Group Computer (CISC) microprocessor, a microcontroller, an Application Specific Integrated Circuit (ASIC), a Field-Programmable Gate Array (FPGA), a System-on-a-Chip (SoC), a digital signal processor (DSP), and so forth. Further, the processor(s) 602 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 602 may be capable of supporting any of a variety of instruction groups.

In addition, the device 600 may include one or more input/output (I/O) interfaces 606 that may facilitate the receipt of input information by the device 600 from one or more I/O devices as well as the output of information from the device 600 to the one or more I/O devices. The I/O devices may include, for example, one or more user interface devices that facilitate interaction between a user and the device 600 including, but not limited to, a display, a keypad, a pointing device, a control panel, a touch screen display, a remote control device, a microphone, a speaker, and so forth. The I/O devices may further include, for example, any number of peripheral devices such as data storage devices, printing devices, and so forth.

The device 600 may further include one or more network interfaces 608 via which the device 600 may communicate with any of a variety of other systems, platforms, networks, devices, and so forth. Such communication may occur via one or more networks including, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

The antenna(s) (not shown) may include any suitable type of antenna depending, for example, on the communications protocols used to transmit or receive signals via the antenna(s). Non-limiting examples of suitable antennas may include directional antennas, non-directional antennas, dipole antennas, folded dipole antennas, patch antennas, multiple-input multiple-output (MIMO) antennas, or the like. The antenna(s) may be communicatively coupled to one or more transceivers 612 or radio components to which or from which signals may be transmitted or received.

The transceiver(s) 612 may include any suitable radio component(s) for—in cooperation with the antenna(s)—transmitting or receiving radio frequency (RF) signals in the bandwidth and/or channels corresponding to the communications protocols utilized by the device 600 to communicate with other devices. The transceiver(s) 612 may include hardware, software, and/or firmware for modulating, transmitting, or receiving—potentially in cooperation with any of antenna(s)—communications signals according to any suitable communication protocol including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 612 may further include hardware, firmware, or software for receiving GNSS signals. The transceiver(s) 612 may include any known receiver and baseband suitable for communicating via the communications protocols utilized by the device 600. The transceiver(s) 612 may further include a low noise amplifier (LNA), additional signal amplifiers, an analog-to-digital (A/D) converter, one or more buffers, digital baseband, or the like.

The sensor(s)/sensor interface(s) 610 may include or may be capable of interfacing with any suitable type of sensing device such as, for example, ambient light sensors, inertial sensors, force sensors, thermal sensors, image sensors, magnetometers, and so forth. Example types of inertial sensors may include accelerometers (e.g., MEMS-based accelerometers), gyroscopes, and so forth.

It should be appreciated that the program modules, applications, computer-executable instructions, code, or the like depicted in FIG. 6 as being stored in the data storage 616 are merely illustrative and not exhaustive and that processing described as being supported by any particular module may alternatively be distributed across multiple modules or performed by a different module. In addition, various program module(s), script(s), plug-in(s), Application Programming Interface(s) (API(s)), or any other suitable computer-executable code hosted locally on the device 600, and/or hosted on other computing device(s) accessible via one or more networks, may be provided to support functionality provided by the program modules, applications, or computer-executable code depicted in FIG. 6 and/or additional or alternate functionality. Further, functionality may be modularized differently such that processing described as being supported collectively by the collection of program modules depicted in FIG. 6 may be performed by a fewer or greater number of modules, or functionality described as being supported by any particular module may be supported, at least in part, by another module. In addition, program modules that support the functionality described herein may form part of one or more applications executable across any number of systems or devices in accordance with any suitable computing model such as, for example, a client-server model, a peer-to-peer model, and so forth. In addition, any of the functionality described as being supported by any of the program modules depicted in FIG. 6 may be implemented, at least partially, in hardware and/or firmware across any number of devices.

It should further be appreciated that the device 600 may include alternate and/or additional hardware, software, or firmware components beyond those described or depicted without departing from the scope of the disclosure. More particularly, it should be appreciated that software, firmware, or hardware components depicted as forming part of the device 600 are merely illustrative and that some components may not be present or additional components may be provided in various embodiments. In addition, the device 600 may include other display components beyond those shown or described. While various illustrative program modules have been depicted and described as software modules stored in data storage 616, it should be appreciated that functionality described as being supported by the program modules may be enabled by any combination of hardware, software, and/or firmware. It should further be appreciated that each of the above-mentioned modules may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular module may, in various embodiments, be provided at least in part by one or more other modules. Further, one or more depicted modules may not be present in certain embodiments, while in other embodiments, additional modules not depicted may be present and may support at least a portion of the described functionality and/or additional functionality. Moreover, while certain modules may be depicted and described as sub-modules of another module, in certain embodiments, such modules may be provided as independent modules or as sub-modules of other modules.

Illustrative Processes

Figure 3:
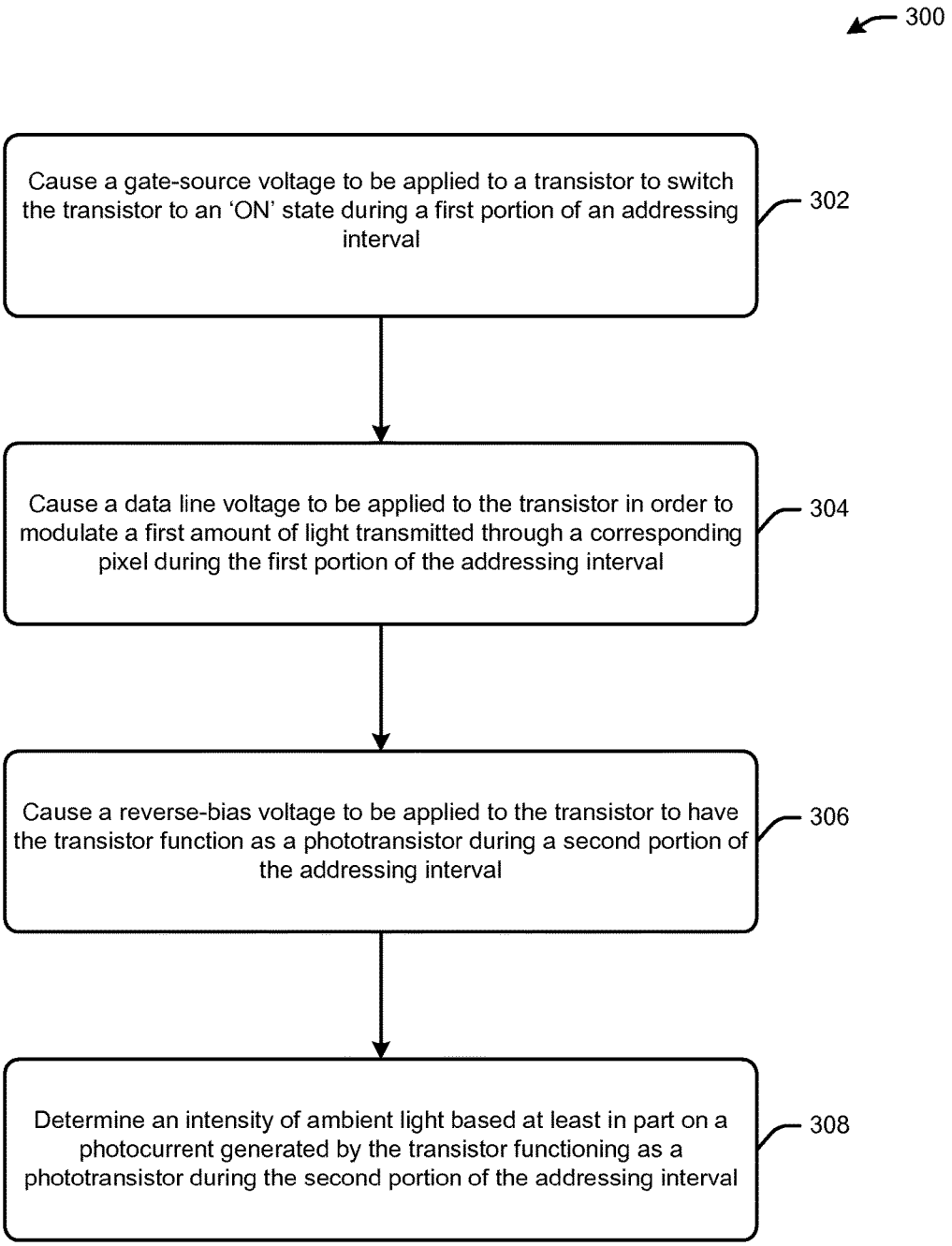
FIG. 3 is a process flow diagram of an illustrative method that utilizes a time-division multiplexing approach to transition between use of a transistor for driving a display pixel and use of the transistor for light sensing in accordance with one or more example embodiments of the disclosure.

FIG. 3 is a process flow diagram of an illustrative method 300 that utilizes a time-division multiplexing approach to transition between use of a transistor for driving a display pixel and use of the transistor for light sensing in accordance with one or more example embodiments of the disclosure.

At block 302, computer-executable instructions of the light modulation module(s) 622 may be executed to cause a gate-source voltage to be applied to a transistor to switch the transistor to an 'ON' state during a first portion of an addressing interval. More specifically, computer-executable instructions of the light modulation module(s) 622 may be executed to generate one or more signals which may be supplied to the timing controller 626 which may, in turn, cause the row driver 628 of the driving circuitry 632 to supply, based on the one or more received signals, a suitable gate-source voltage to a gate electrode of the transistor via a scanning line to cause the transistor to transition to an 'ON' state.

At block 304, computer-executable instructions of the light modulation module(s) 622 may be executed to cause a data line voltage to be applied to the transistor in order to modulate a first amount of light transmitted through a corresponding pixel during the first portion of the addressing interval. More specifically, computer-executable instructions of the light modulation module(s) 622 may be executed to generate one or more signals which may be supplied to the timing controller 626 which may, in turn, cause the column driver 630 of the driving circuitry 632 to supply a data voltage to a data line to charge a storage capacitor of the pixel. The charge of the storage capacitor may alter an orientation of the liquid crystal molecules which may, in turn, reduce an amount of light transmitted through the pixel in proportion to the data voltage.

At block 306, computer-executable instructions of the ambient light sensing control module(s) 618 may be executed to cause a reverse-bias voltage to be applied to the transistor to have the transistor function as a phototransistor during a second portion of the addressing interval. More specifically, computer-executable instructions of the ambient light sensing control module(s) 618 may be executed to generate one or more signals which may be supplied to the timing controller 626 which may, in turn, cause the driving circuitry 632 to apply a reverse-bias voltage indicated by the signal(s) to a bias line connected to the transistor. Application of the reverse-bias voltage to the transistor may cause the transistor to function as a phototransistor during the second portion of the addressing interval. While functioning as a phototransistor, ambient light incident on the transistor may cause a photocurrent to be generated. The photocurrent may be amplified by the amplifier 638, and the amplified analog signal may be converted to a digital signal by the ADC 636. The ADC 636 may provide the digital signal to the ambient light detection module(s) 620.

At block 308, computer-executable instructions of the ambient light detection module(s) 620 may be executed to determine an intensity of ambient light based at least in part on the photocurrent generated by the transistor functioning as a phototransistor during the second portion of the addressing interval. More specifically, computer-executable instructions of the ambient light detection module(s) 620 may be executed to determine an intensity of the ambient light from one or more digital signals indicative of one or more photocurrents generated by one or more transistors functioning as phototransistors during the second portion of the addressing interval.

Figure 4:
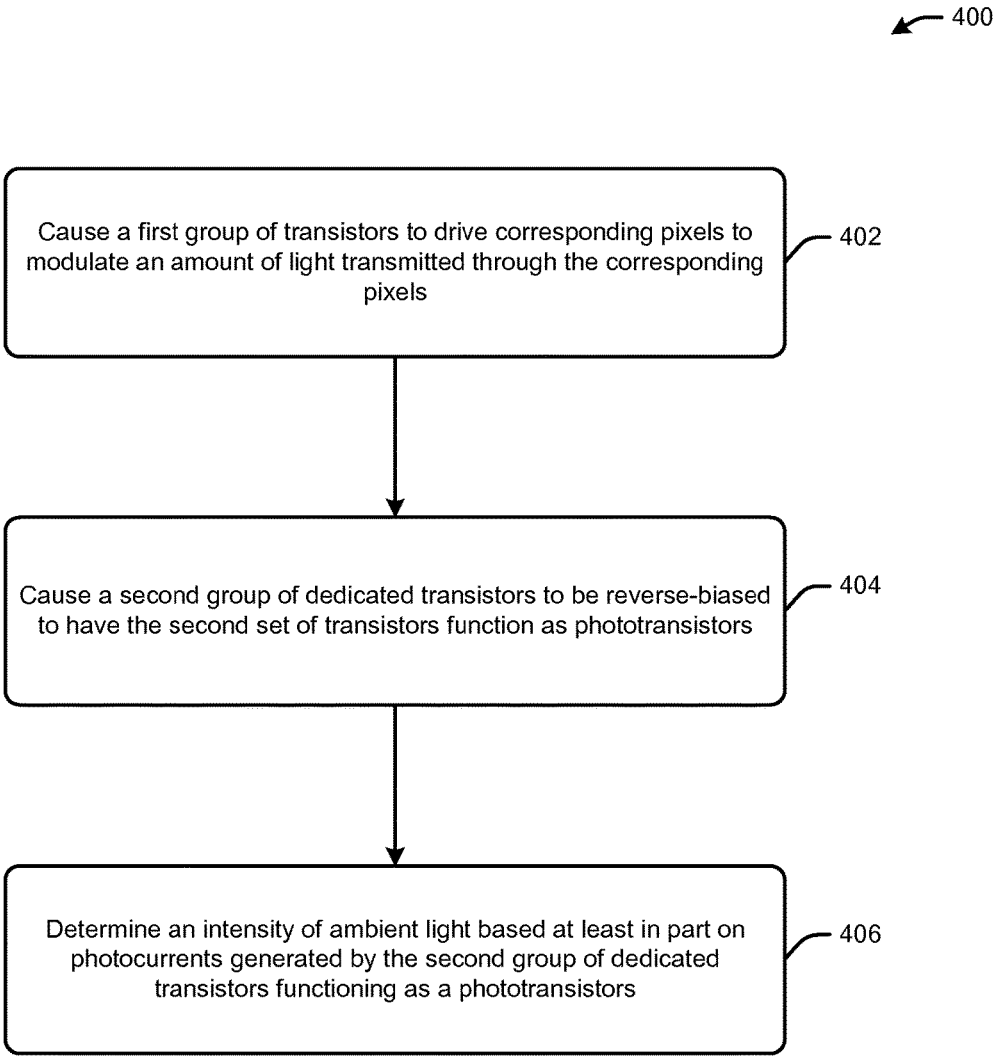
FIG. 4 is a process flow diagram of an illustrative method for using a dedicated group of transistors for light sensing in accordance with one or more example embodiments of the disclosure.

FIG. 4 is a process flow diagram of an illustrative method 400 for using a dedicated group of transistors for light sensing in accordance with one or more example embodiments of the disclosure.

At block 402, computer-executable instructions of the light modulation module(s) 622 may be executed to cause a first group of transistors to drive corresponding pixels to modulate an amount of light transmitted through the corresponding pixels. More specifically, computer-executable instructions of the light modulation module(s) 622 may be executed to provide signals to the timing controller 626 which may cause the row driver 628 and the column driver 630 to apply source-gate voltages and data voltages to the first group of transistors to control an amount of light transmitted through the corresponding pixels.

At block 404, computer-executable instructions of the ambient light sensing control module(s) 618 may be executed to cause a second group of dedicated transistors to be reverse-biased to function as phototransistors. More specifically, computer-executable instructions of the ambient light sensing control module(s) 618 may be executed to generate one or more signals indicative of a reverse-bias voltage to be applied to the second group of transistors. Reverse-biasing the second group of dedicated transistors may cause the transistors to generate photocurrents in response to impingement of incident ambient light. As previously described, the generated photocurrents may be amplified by the amplifier 638 and digitized by the ADC 636. The second group of dedicated transistors may be used solely for light detection and may not be used to control light transmission through corresponding pixels.

At block 406, computer-executable instructions of the ambient light detection module(s) 620 may determine an intensity of detected ambient light based at least in part on photocurrents generated by the second group of dedicated transistors functioning as phototransistors. More specifically, computer-executable instructions of the ambient light detection module(s) 620 may be executed to determine an intensity of the ambient light based on the digital values received from the ADC 636 that indicate the magnitude of the photocurrents generated in the second group of dedicated transistors functioning as phototransistors.

It should be appreciated that the methods 300 and 400 of FIGS. 3 and 4, respectively, merely represent example methods for using display components for light sensing. Various modifications to these example methods are also within the scope of this disclosure. For example, rather than using a time-division multiplexing approach or a dedicated group of transistors for sensing ambient light, a group of photodiodes may instead be used. The photodiodes may be provided at various pixel positions in addition to, or in lieu of, transistors.

Figure 5:
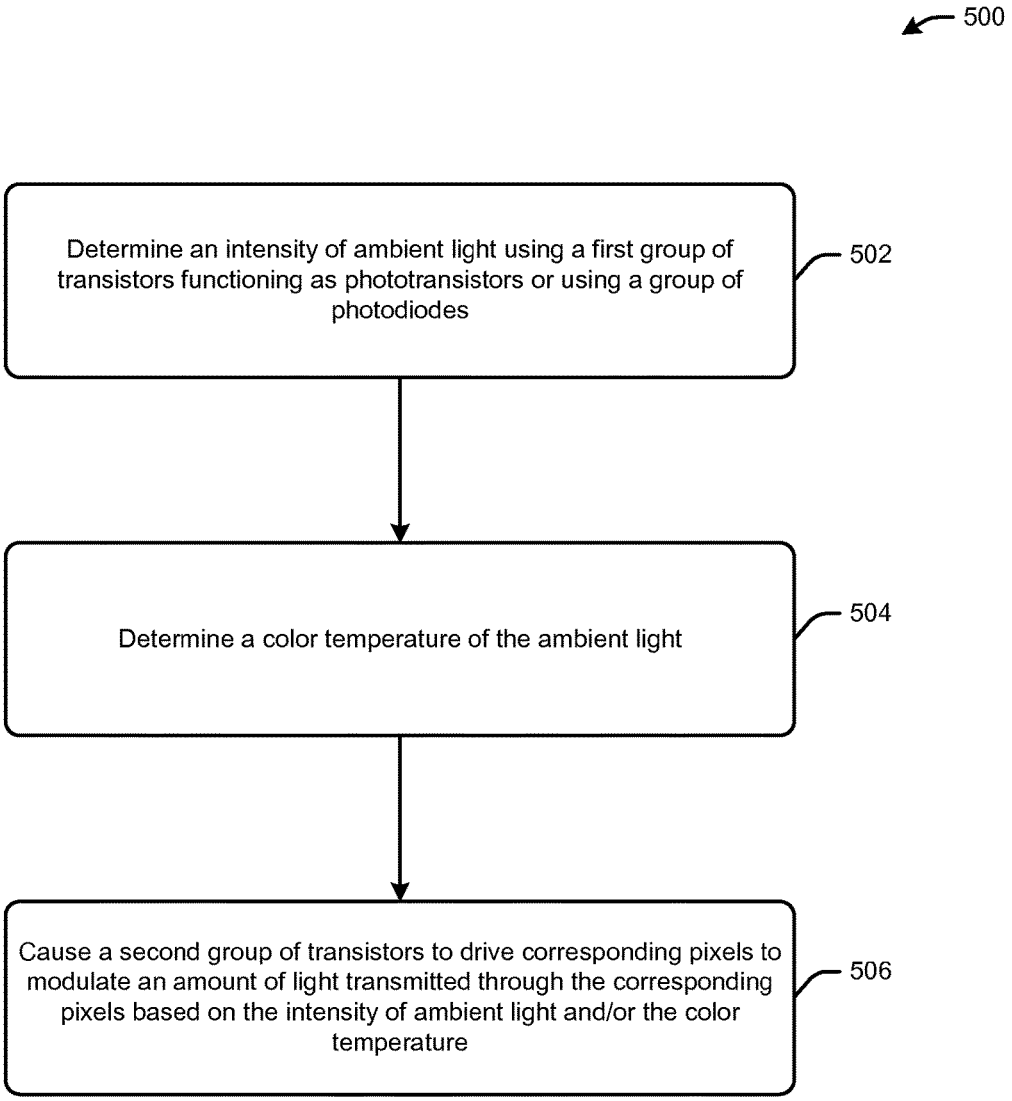
FIG. 5 is a process flow diagram of an illustrative method for determining an amount of ambient light and a color temperature of the ambient light sensed by a group of phototransistors or photodiodes and modulating an amount of light emitted, transmitted, or reflected by a display based at least in part on the ambient light and/or the color temperature in accordance with one or more example embodiments of the disclosure.

FIG. 5 is a process flow diagram of an illustrative method 500 for determining an amount of ambient light and a color temperature of the ambient light sensed by a group of phototransistors or photodiodes and modulating an amount of light emitted or transmitted by a display based at least in part on the ambient light and/or the color temperature in accordance with one or more example embodiments of the disclosure.

At block 502, computer-executable instructions of the ambient light detection module(s) 620 may be executed to determine an intensity of ambient light using a first group of transistors functioning as phototransistors or using a group of photodiodes.

At block 504, computer-executable instructions of the ambient light detection module(s) 620 may be executed to determine a color temperature of the ambient light. In certain example embodiments, computer-executable instructions of the ambient light detection module(s) 620 may be executed to determine a color temperature of ambient light by comparing signals received from phototransistors or photodiodes associated with different color sub-pixels. For example, the ambient light detection module(s) 620 may compare photocurrents generated by reversed-biased transistors associated with red sub-pixels to photocurrents generated by reverse-biased transistors associated with blue and/or green sub-pixels to determine a color temperature of the incoming ambient light.

At block 506, computer-executable instructions of the light modulation module(s) 622 may be executed to cause a second group of transistors to drive corresponding pixels to modulate an amount of light transmitted through the corresponding pixels based at least in part on an intensity of the ambient light and/or the color temperature. More specifically, computer-executable instructions of the light modulation module(s) 622 may be executed to generate one or more signals that may be supplied to the timing controller 626 which may, in turn, cause the row driver 626 and the column driver 628 to supply, based on the received signal(s), gate-source voltages and data voltages, respectively, to the second group of transistors to cause the amount of light transmitted through corresponding pixels to be modulated accordingly. For example, for a greater intensity of ambient light, lower data voltages may be applied to the second group of transistors to increase the amount of light transmitted through corresponding pixels. As another example, if the color temperature indicates that the ambient light is shifted towards a particular portion of the visible light spectrum, the light modulation module(s) 622 may provide signals to the timing controller 626 to cause the driving circuitry 632 to supply voltages to the second group of transistors that modify the color temperature of light transmitted through corresponding pixels to compensate for the shift in the ambient light.

One or more operations of the methods 300, 400, and 500 may have been described above as being performed by one or more components of the device 600, or more specifically, by one or more one or more program modules executing on such a device 600. It should be appreciated, however, that any of the operations of methods 300, 400, or 500 may be performed, at least in part, in a distributed manner by one or more other devices or systems, or more specifically, by one or more program modules, applications, or the like executing on such devices. In addition, it should be appreciated that processing performed in response to execution of computer-executable instructions provided as part of an application, program module, or the like may be interchangeably described herein as being performed by the application or the program module itself or by a device on which the application, program module, or the like is executing. While the operations of the method 600 may be described in the context of the illustrative device 600, it should be appreciated that such operations may be implemented in connection with numerous other system configurations.

The operations described and depicted in the illustrative method of FIGS. 3-5 may be carried out or performed in any suitable order as desired in various example embodiments of the disclosure. Additionally, in certain example embodiments, at least a portion of the operations may be carried out in parallel. Furthermore, in certain example embodiments, less, more, or different operations than those depicted in FIGS. 3-5 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Program modules, applications, or the like disclosed herein may include one or more software components including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program modules, or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. A method, comprising:

applying, by driving circuitry of an electronic device, a first voltage to a first transistor to cause a first pixel of the electronic device to emit, transmit, or reflect a first amount of light;

applying, by the driving circuitry, a second voltage to a second transistor to reverse-bias the second transistor to cause the second transistor to operate as a phototransistor;

detecting, by ambient light detection circuitry of the display device, a current generated by the second transistor, wherein the current is generated based at least in part on detection of ambient light by the second transistor;

determining, by one or more computer processors, an intensity of the ambient light based at least in part on a magnitude of the current;

determining; by the one or more computer processors, a value of a third voltage based at least in part on a difference between the intensity of the ambient light and a reference intensity, wherein the value of the third voltage is indicative of an extent by which the first voltage is to be modified to cause the first pixel to emit, transmit, or reflect the second amount of light; and applying, by the driving circuitry, the third voltage to the first transistor to cause the first pixel to emit, transmit, or reflect a second amount of light.

2. The method of claim 1, further comprising:

determining, by the one or more computer processors, a difference between the intensity of the ambient light and a reference intensity of the ambient light, wherein the intensity of the ambient light is greater than the reference intensity, wherein determining the value of the third voltage comprises determining, using the difference, an extent by which the first voltage is to be modified to cause the first pixel to emit, transmit, or reflect the second amount of light that is greater than the first amount of light.

3. The method of claim 1, further comprising:

determining, by the one or more computer processors, a difference between the intensity of the ambient light and a reference intensity of the ambient light, wherein the intensity of the ambient light is less than the reference intensity, wherein the second amount of light that is less than the first amount of light.

4. The method of claim 1, further comprising:

determining, by the one or more computer processors, a value of a fourth voltage based at least in part on the intensity of the ambient light to cause an amount of light emitted, transmitted, or reflected by a second pixel of the electronic device to increase or decrease by a same amount as a difference between the first amount of light and the second amount of light; and applying, by the driving circuitry, the fourth voltage to a third transistor corresponding to the second pixel.

5. The method of claim 1, wherein the first transistor is a driving transistor for driving the first pixel and the second transistor is a dedicated phototransistor corresponding to a second pixel.

6. The method of claim 5, wherein the first transistor is at a first distance from a periphery of a display of the electronic device and the second transistor is at a second distance from the periphery of the display, and wherein the second distance is shorter than the first distance.

7. The method of claim 1, wherein the first transistor and the second transistor are a same transistor, and wherein the first voltage is applied during a first portion of an addressing interval and the second voltage is applied during a second portion of the addressing interval that occurs after the first portion.

8. The method of claim 1, wherein the ambient light detected by the second transistor passes through a color filter, the method further comprising:

determining, by the one or more computer processors, a color temperature of the ambient light from the intensity of the ambient light and a type of the color filter, wherein the value of the third voltage or the second current is further determined based at least in part on the color temperature.

9. A device, comprising:

a display comprising a plurality of pixels and a plurality of transistors, wherein each of the plurality of pixels corresponds to a respective one or more of the plurality of transistors;

driving circuitry coupled to one or more of the plurality of transistors;

ambient light detection circuitry;

a timing controller communicatively coupled to the driving circuitry and the ambient light detection circuitry;

at least one processor communicatively coupled to at least the timing controller; and at least one memory storing computer-executable instructions, wherein the at least one processor is configured to access the at least one memory and execute the computer-executable instructions to:

generate and transmit a first signal to the timing controller to cause the driving circuitry to apply a first voltage to a first transistor of the plurality of transistors to cause a corresponding first pixel of the plurality of pixels to emit, transmit, or reflect a first amount of light;

generate and transmit a second signal to the timing controller to cause the driving circuitry to apply a second voltage to a second transistor to reverse-bias the second transistor to cause the second transistor to operate as a phototransistor;

receive, from the ambient light detection circuitry, a digital value indicative of a current generated by the second transistor, wherein the current is generated based at least in part on detection of ambient light by the second transistor;

determine an intensity of the ambient light based at least in part on a magnitude of the current;

determine a value of a third voltage based at least in part on a difference between the intensity of the ambient light and reference intensity, wherein the value of the third voltage is indicative of an extent by which the first voltage is to be modified to cause the first pixel to emit, transmit, or reflect the second amount of light; and generate and transmit a third signal to the timing controller to cause the driving circuitry to apply the third voltage to the first transistor to cause the first pixel to emit, transmit, or reflect a second amount of light, wherein a difference between the first amount of light and the second amount of light compensates for the intensity of the ambient light.

10. The device of claim 9, wherein the at least one processor is further configured to execute the computer-executable instructions to:

determine a difference between the intensity of the ambient light and a reference intensity of the ambient light, and determine, using the difference, the value of the third voltage by determining an extent by which the first voltage is to be modified to cause the first pixel to emit, transmit, or reflect the second amount of light instead of the first amount of light.

11. The device of claim 9, wherein the wherein the first transistor is a driving transistor for driving the first pixel and the second transistor is a dedicated phototransistor corresponding to a second pixel.

12. The device of claim 11, wherein the first transistor is a first distance from a periphery of the display and the second transistor is a second distance from the periphery of the display, and wherein the second distance is shorter than the first distance.

13. The device of claim 9, wherein the first transistor and the second transistor are a same transistor, and wherein the first voltage is applied during a first portion of an addressing interval and the second voltage is applied during a second portion of the addressing interval that occurs after the first portion.

14. The device of claim 9, wherein the ambient light detected by the second transistor passes through a color filter, and wherein the at least one processor is further configured to execute the computer-executable instructions to:

determine a color temperature of the ambient light from the intensity of the ambient light and a type of the color filter, wherein the value of the third voltage is further determined based at least in part on the color temperature.

15. The device of claim 9, wherein the digital value is a first digital value, wherein the current is a first current, wherein the display further comprises a photodiode, and wherein the at least one processor is further configured to execute the computer-executable instructions to:

receive, from the ambient light detection circuitry, a second digital value indicative of a second current generated by the photodiode, wherein the second current is generated based at least in part on detection of the ambient light by the photodiode, wherein the intensity of the ambient light is determined further based at least in part on a magnitude of the second current.

16. A method, comprising:

applying, by driving circuitry of an electronic device, a first voltage to a first transistor cause a first pixel of the electronic device to emit, transmit, or reflect a first amount of light;

applying, by the driving circuitry, a second voltage to a second transistor to reverse-bias the second transistor to cause the second transistor to operate as a phototransistor;

detecting, by ambient light detection circuitry of the display device, a current generated by the second transistor, wherein the current is generated based at least in part on detection of ambient light by the second transistor;

determining, by one or more computer processors, an intensity of the ambient light based at least in part on a magnitude of the current;

determining, by the one or more computer processors, a value of a third voltage based at least in part on the intensity of the ambient light to cause an amount of light emitted, transmitted, or reflected by a second pixel of the electronic device to change by a same amount as a difference between the first amount of light and a second amount of light emitted, transmitted, or reflected by the first pixel; and applying, by the driving circuitry, the third voltage to a particular transistor corresponding to the second pixel.

17. The method of claim 16, further comprising:

determining, by the one or more computer processors, a difference between the intensity of the ambient light and a reference intensity of the ambient light, wherein the intensity of the ambient light is greater than the reference intensity, wherein determining the value of the third voltage comprises determining, using the difference, an extent by which the first voltage is to be modified to cause the first pixel to emit, transmit, or reflect the second amount of light that is greater than the first amount of light.

18. The method of claim 16, further comprising:

determining, by the one or more computer processors, a difference between the intensity of the ambient light and a reference intensity of the ambient light, wherein the intensity of the ambient light is less than the reference intensity, wherein determining a value of the third voltage comprises determining, using the difference, an extent by which the first voltage is to be modified to cause the first pixel to emit, transmit, or reflect the second amount of light that is less than the first amount of light.

19. The method of claim 16, wherein the ambient light detected by the second transistor passes through a color filter, the method further comprising:

determining, by the one or more computer processors, a color temperature of the ambient light from the intensity of the ambient light and a type of the color filter, wherein the value of the third voltage or the second current is further determined based at least in part on the color temperature.

* * * * *